US008893588B2

(12) United States Patent
Chien

(10) Patent No.: US 8,893,588 B2
(45) **Date of Patent: *Nov. 25, 2014**

(54) RATCHET WRENCH

(76) Inventor: Yu Yen Chien, Taichung (TW)

( * ) Notice: Subject to any disclaimer, the term of this patent is extended or adjusted under 35 U.S.C. 154(b) by 184 days.

This patent is subject to a terminal disclaimer.

(21) Appl. No.: 13/569,226

(22) Filed: Aug. 8, 2012

(65) Prior Publication Data

US 2014/0041487 A1 Feb. 13, 2014

(51) Int. Cl.
*B25B 13/46* (2006.01)
*B25B 23/00* (2006.01)

(52) U.S. Cl.
USPC ..... 81/60; 81/61

(58) Field of Classification Search
USPC ..... 81/60–63.2
See application file for complete search history.

(56) References Cited

U.S. PATENT DOCUMENTS 6,161,454 A 12/2000 Chaconas
6,164,166 A 12/2000 Whiteford
6,220,123 B1 4/2001 Chen
6,260,449 B1 7/2001 I-He
6,282,991 B1 9/2001 Hu
6,357,323 B2 3/2002 Chi et al.
6,386,072 B1 5/2002 Yuan-Chin et al.
6,435,062 B1 8/2002 McCann
6,435,063 B1 8/2002 Chen
6,467,378 B1 10/2002 Chen
6,959,626 B1 11/2005 Shen
7,114,415 B1 10/2006 Chiang
8,555,752 B1 * 10/2013 Chien ..... 81/63.2

* cited by examiner

*Primary Examiner* — David B Thomas
(74) *Attorney, Agent, or Firm* — Charles E. Baxley

(57) ABSTRACT

A ratchet wrench includes a driving head, two retaining rings engaged in the driving head, a driving member rotatably engaged in the driving head and having a gear, and a pawl engaged in the driving head and having a lever arm extended from a shaft, and one or more teeth formed on the lever arm for engaging with the gear and for determining the driving direction of the driving member by the driving head and the handle, the shaft includes two end segments extended beyond the lever arm for forming two engaging surfaces and for engaging with the retaining rings and for allowing the retaining rings to apply a spring biasing force onto the end segments of the shaft and to force the teeth of the lever arm to engage with the gear.

6 Claims, 4 Drawing Sheets

RATCHET WRENCH

BACKGROUND OF THE INVENTION

1. Field of the Invention

The present invention relates to a ratchet wrench, and more particularly to a ratchet wrench including an improved structure having fewer parts or elements to be easily and quickly assembled and manufactured with a decreased manufacturing cost and having an increased driving torque or strength for preventing the ratchet wrench from being easily and quickly worn out or damaged.

2. Description of the Prior Art

Typical ratchet wrenches comprise a driving head formed or provided on one end portion of a handle and including a chamber or compartment formed in the driving head for pivotally or rotatably receiving or engaging with a driving shank or member or cartridge, and a pawl movably disposed or attached or mounted or secured or engaged in the driving head for selectively engaging with the gear that is formed and provided on the driving shank or member or cartridge and for determining or controlling the rotating or driving direction of the driving shank or member or cartridge with or by the driving head and the handle.

For example, U.S. Pat. No. 6,161,454 to Chaconas, U.S. Pat. No. 6,164,166 to Whiteford, U.S. Pat. No. 6,220,123 to Chen, U.S. Pat. No. 6,260,449 to I-He, U.S. Pat. No. 6,282,991 to Hu, U.S. Pat. No. 6,357,323 to Chi et al., U.S. Pat. No. 6,386,072 to Yuan-Chin et al., U.S. Pat. No. 6,435,062 to McCann, U.S. Pat. No. 6,435,063 to Chen, U.S. Pat. No. 6,467,378 to Chen, U.S. Pat. No. 6,959,626 to Shen, and U.S. Pat. No. 7,114,415 to Chiang disclose several of the typical ratchet wrenches each also comprising a driving head formed or provided on one end portion of a handle and including a chamber or compartment formed in the driving head for pivotally or rotatably receiving or engaging with a driving shank or member or cartridge, and a pawl movably disposed or attached or mounted or secured or engaged in the driving head for selectively engaging with the gear that is formed and provided on the driving shank or member or cartridge and for determining or controlling the rotating or driving direction of the driving shank or member or cartridge with or by the driving head and the handle.

Normally, a controlling or switching device is further required to be provided and engaged into the handle and/or the driving head and coupled or engaged with the pawl for controlling or switching the pawl to engage with the gear at different portions or segments of the gear and thus to determine or control the rotating or driving direction of the driving shank or member or cartridge with or by the driving head and the handle, and thus for allowing various tool shanks, tool extensions, tool elements, fasteners, driven members or the like to be rotated or driven with or by the handle and/or the driving head.

However, the pawl and the controlling or switching device may include a number of parts or elements, and may occupy a great space or volume in the handle and/or the driving head, and the handle and/or the driving head should be drilled or machined or milled with a great space or volume that is large enough to receive and engage with the pawl and the controlling or switching device such that the strength and/or the driving torque of the handle and/or the driving head will be greatly decreased.

The present invention has arisen to mitigate and/or obviate the afore-described disadvantages of the conventional ratchet wrenches or tools or the like.

SUMMARY OF THE INVENTION

The primary objective of the present invention is to provide a ratchet wrench including an improved structure having fewer parts or elements to be easily and quickly assembled and manufactured with a decreased manufacturing cost.

The other objective of the present invention is to provide a ratchet wrench including an increased driving torque or strength for preventing the ratchet wrench from being easily and quickly worn out or damaged.

In accordance with one aspect of the invention, there is provided a ratchet wrench comprising a handle including a driving head formed or provided on one end portion thereof, the driving head including a chamber formed therein, and including a recess formed in the driving head and communicating with the chamber of the driving head, and including a first peripheral groove and a second peripheral groove formed in the driving head and communicating with the chamber and the recess of the driving head, and including a swelling or projection extended into the recess of the driving head for forming and defining a relatively greater compartment and a relatively smaller space in the recess of the driving head, a first retaining ring and a second retaining ring engaged into the first and the second peripheral grooves of the driving head respectively and extended through the recess of the driving head, a driving member including a tubular or cylindrical body element rotatably received and engaged in the chamber of the driving head, and including a gear formed and provided on the body element and faced and directed toward the first and the second peripheral grooves and the recess of the driving head and the first and the second retaining rings, and a pawl including a shaft received and engaged in the compartment of the recess of the driving head, and including a lever arm extended from the shaft and extended into the space of the recess of the driving head, and including at least one tooth formed and provided on the lever arm for selectively engaging with the gear of the driving member and for determining a driving direction of the driving member by the driving head and the handle, the shaft including a height greater than that of the lever arm and extended beyond the lever arm for forming and defining a first end segment and a second end segment and for forming and defining two engaging surfaces on the first and the second end segments respectively, and for engaging with the first and the second retaining rings respectively and for allowing the first and the second retaining rings to apply a spring biasing force onto the first and the second end segments of the shaft of the pawl respectively, and for biasing and forcing the at least one tooth of the lever arm to engage with the gear, and the at least one tooth of the lever arm is forced to engage with the gear of the driving member when the driving head and the handle are rotated and driven in a driving direction for allowing the driving member to be rotated and driven by the driving head and the handle in the driving direction, and the at least one tooth of the lever arm is allowed to be moved away from the gear of the driving member and to be selectively received and engaged in the space of the recess of the driving head when the driving head and the handle are rotated and driven in an opposite releasing direction, for allowing the driving head and the handle to be rotated freely relative to the driving member in the opposite releasing direction.

The compartment of the recess of the driving head is a relatively greater compartment having a size or dimension or volume or area greater than that of the space of the recess of the driving head, and the space of the recess of the driving head is a relatively smaller space having a size or dimension or volume or area smaller than that of the compartment of the recess of the driving head.

The driving member includes a peripheral flap extended laterally and outwardly from the upper portion of the body element for contacting and engaging with the driving head and for limiting the driving member to move relative to the driving head and for preventing the driving member from being disengaged from the driving head.

The driving head includes a peripheral flange extended radially and inwardly into the chamber of the driving head for forming and defining an inner peripheral shoulder in the driving head, and the driving member includes an outer peripheral shoulder formed therein for engaging with the peripheral flange and the inner peripheral shoulder of the driving head and for further stably and solidly anchoring and positioning the driving member to the driving head.

The driving head includes a third peripheral groove formed therein, and the driving member includes an outer peripheral depression formed therein and aligned with the third peripheral groove of the driving head for receiving and engaging with a retaining ring which may stably and solidly secure and retain the driving member to the driving head.

The driving head includes an opening formed therein and communicating with the chamber of the driving head, and the driving member includes a notch formed therein for selectively communicating with the opening of the driving head and for allowing the tool shanks, tool extensions, tool elements, fasteners, driven members or the like to be easily and quickly engaged through the opening of the driving head and the notch and then engaged into the engaging hole of the driving member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
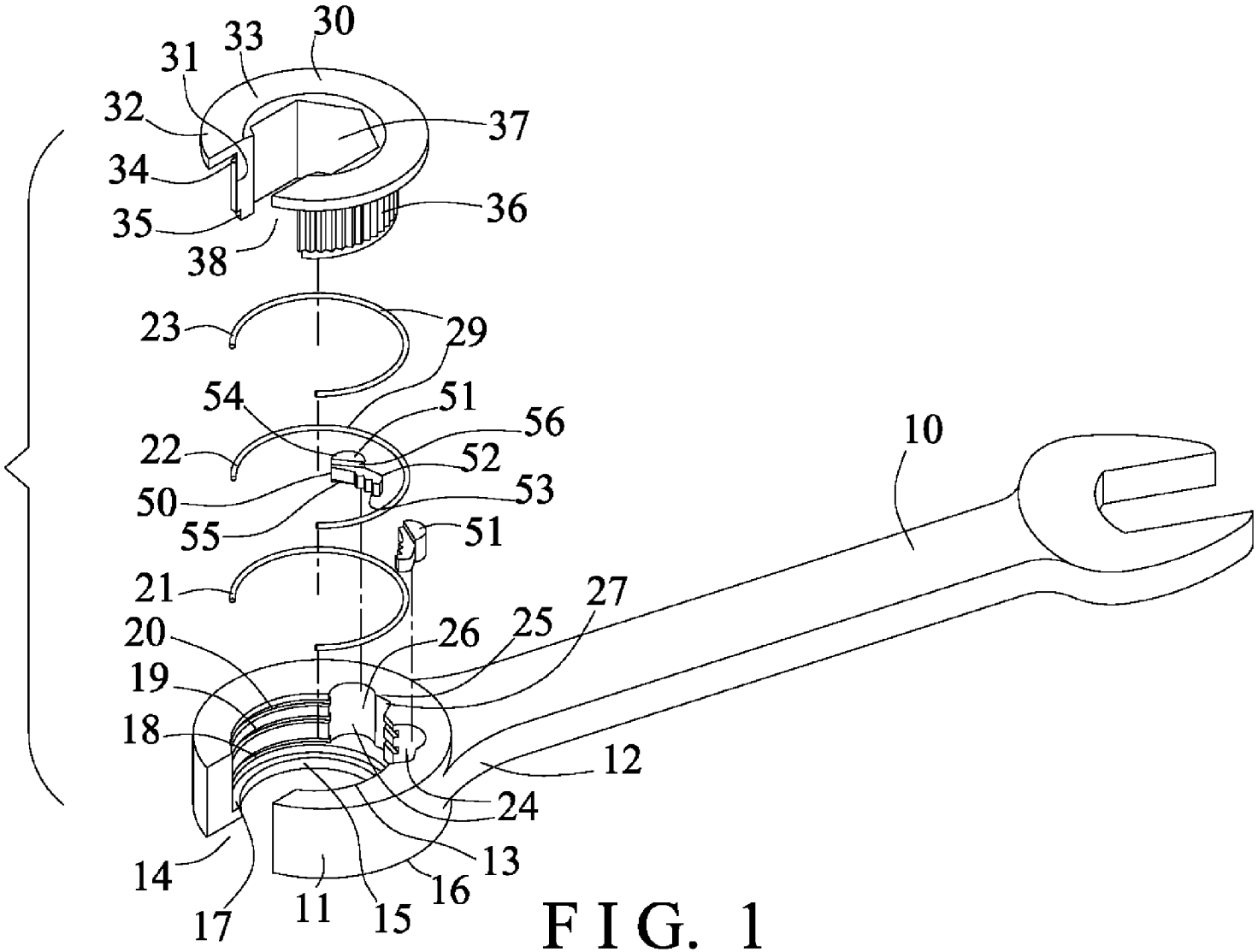
FIG. 1 is an exploded view of a ratchet wrench in accordance with the present invention.
Figure 2:
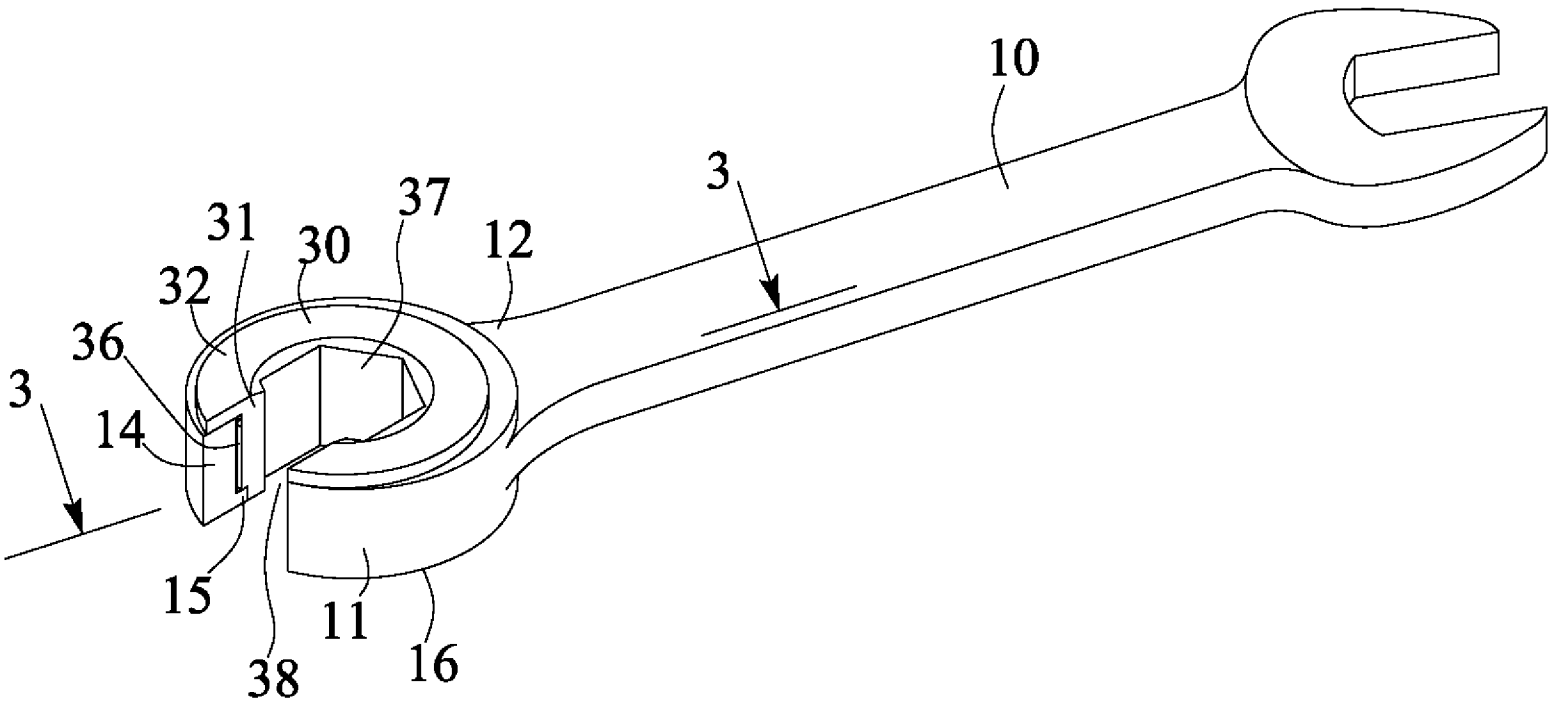
FIG. 2 is a perspective view of the ratchet wrench.
Figure 3:
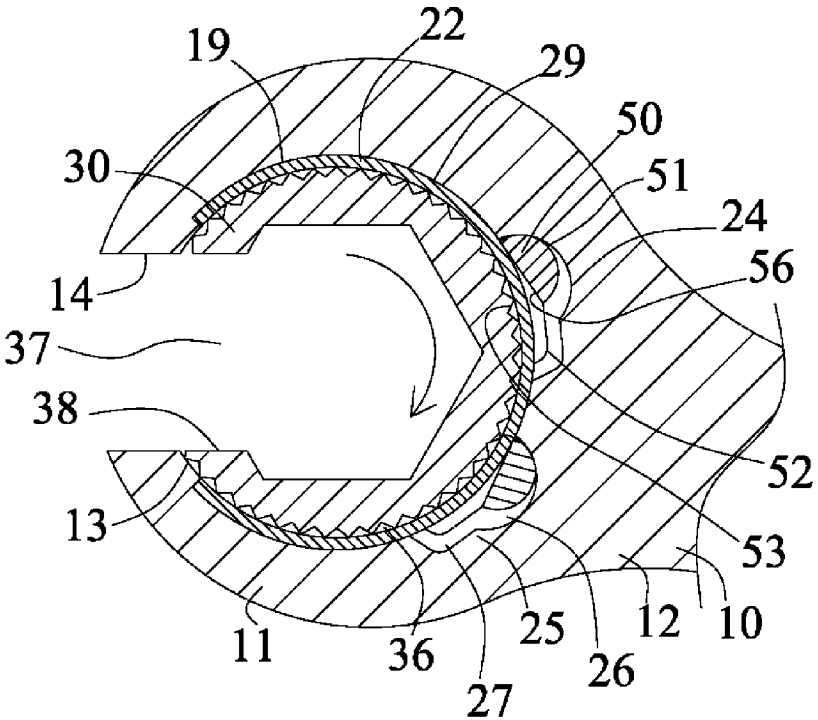
FIG. 3 is a partial cross sectional view of the ratchet wrench taken along lines 3-3 of FIG. 2.

Referring to the drawings, and initially to FIGS. 1-3, a ratchet wrench in accordance with the present invention comprises a driving handle 10 including a driving head 11 formed or provided on one end portion 12 of the handle, and including a chamber 13 formed in the one end portion 12 of the handle or of the driving head 11 for pivotally or rotatably receiving or engaging with a driving shank or cartridge or member 30, the driving head 11 may further include a gap or slot or opening 14 formed therein and communicating with the chamber 13 of the driving head 11. The driving head 11 further includes a peripheral rib or flange 15 extended radially and inwardly into the chamber 13 at the bottom portion 16 of the driving head 11 for forming or defining an inner peripheral shoulder 17 in the bottom portion 16 of the driving head 11.

The driving head 11 further includes two or more (such as three) inner peripheral channels or grooves 18, 19, 20 formed therein, such as a lower or first peripheral groove 18, a middle or intermediate or second peripheral groove 19, and an upper or third peripheral groove 20 formed therein for receiving or engaging with clamping or anchoring or retaining rings 21, 22, 23 therein respectively in which the retaining rings 21-23 are offset or separated from the opening 14 of the driving head 11 (FIGS. 3, 4), and the lower or first retaining ring 21 is disposed or located below the other two retaining rings 22-23, and the upper or third retaining ring 23 is disposed or located above the other two retaining rings 21-22, i.e., the middle or intermediate or second retaining ring 22 is disposed or located between the other two retaining rings 21, 23. The driving head 11 further includes one or more (such as two) cavities or depressions or recesses 24 formed therein and communicating with the chamber 13 and the inner peripheral grooves 18-20 of the driving head 11.

Figure 4:
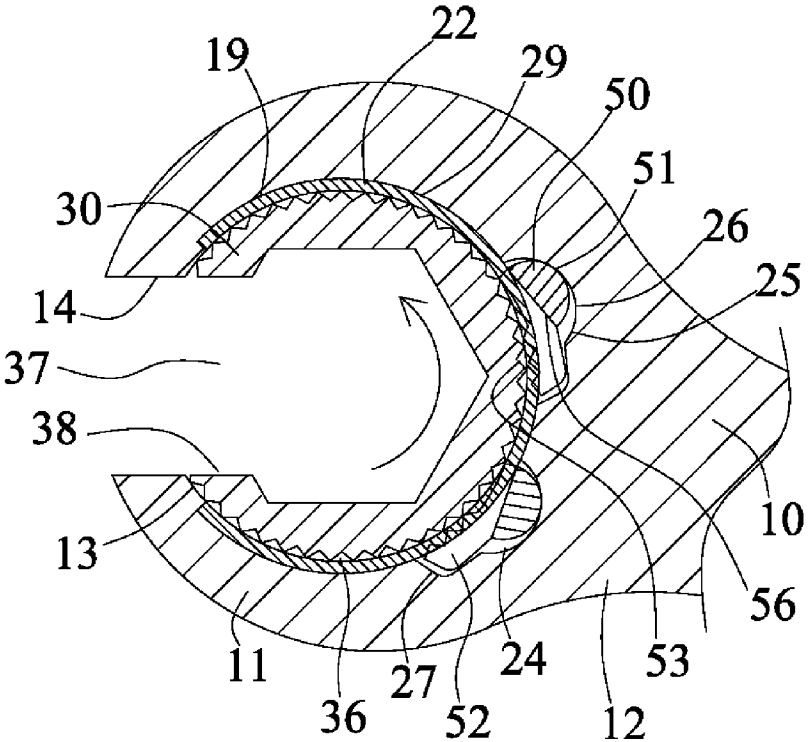
FIG. 4 is a partial cross sectional view similar to FIG. 3, illustrating the operation of the ratchet wrench.

As best shown in FIGS. 1 and 3-4, the driving head 11 further includes a jut or swelling or protrusion or projection 25 extended into a middle or intermediate portion of each of the recesses 24 of the driving head 11 for forming or defining a relatively greater rounded or curved compartment 26 and a relatively smaller space 27 in each of the recesses 24 of the driving head 11. The driving shank or cartridge or member 30 includes a tubular or cylindrical body portion or piece or element 31 pivotally or rotatably received or engaged in the chamber 13 of the driving head 11, and includes an outer peripheral flange or rib or flap 32 extended laterally and outwardly from the upper portion 33 of the cylindrical body element 31 for contacting or engaging with the driving head 11 and for limiting the driving member 30 to slide or move relative to the driving head 11 and for preventing the driving member 30 from being disengaged or separated from the driving head 11.

The driving member 30 further includes an outer peripheral channel or groove or recess or depression 34 formed therein, such as formed in the upper portion 33 of the cylindrical body element 31 and aligned with the upper inner peripheral groove 20 of the driving head 11 for receiving or engaging with the upper retaining ring 23 and for solidly and stably attaching or mounting or securing or anchoring or retaining or positioning the driving member 30 to the driving head 11 and for preventing the driving member 30 from being disengaged or separated from the driving head 11, and further includes an outer peripheral channel or groove or recess or shoulder 35 formed therein for receiving or engaging with the peripheral flange 15 and/or the inner peripheral shoulder 17 of the driving head 11 and for further solidly and stably securing or anchoring or retaining or positioning the driving member 30 to the driving head 11.

Figure 5:
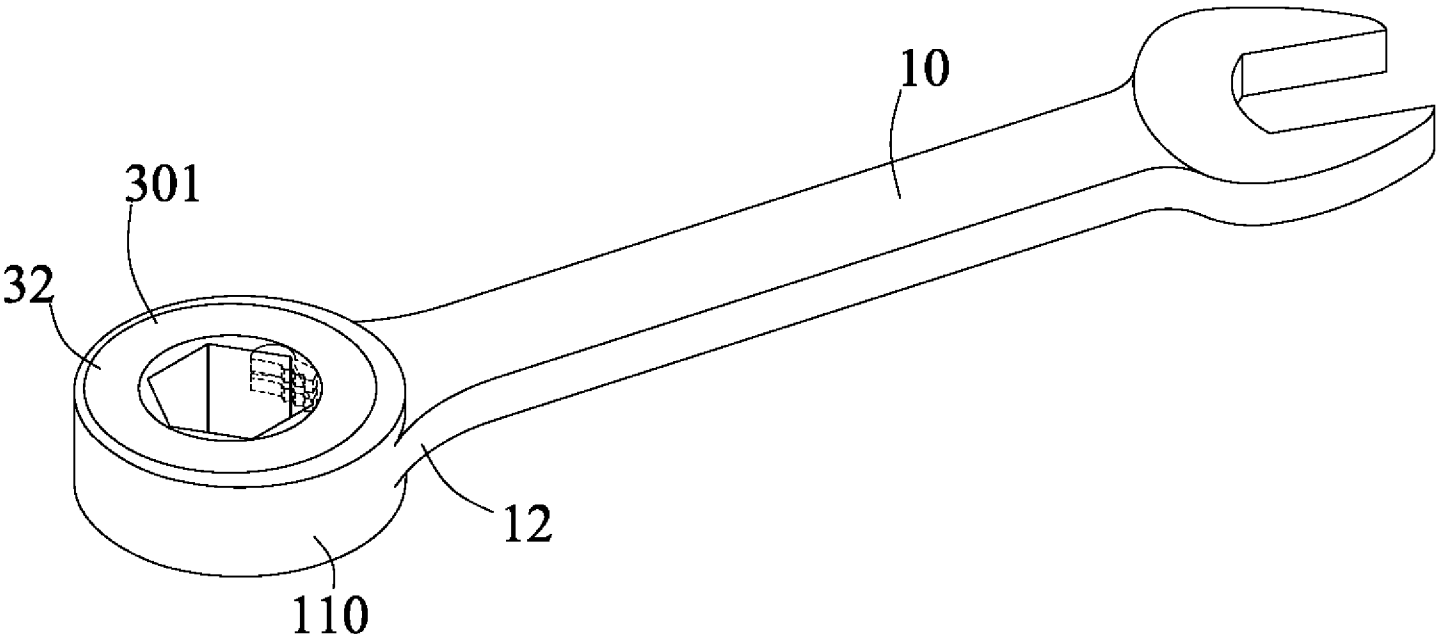
FIG. 5 is another perspective view similar to FIG. 2, illustrating the other arrangement of the ratchet wrench.

The driving member 30 further includes a gear or gear wheel 36 formed and provided on the outer peripheral portion of the cylindrical body element 31 and facing or directing toward the inner peripheral grooves 18-20 and/or the recesses 24 of the driving head 11 and the retaining rings 21-23, and includes a non-circular engaging space or compartment or opening or hole 37 formed therein for receiving or engaging with various tool shanks, tool extensions, tool elements, fasteners, driven members (not shown) or the like, or alternatively, may include a driving shank or stem extended therefrom (not shown). The driving member 30 further includes a gap or opening or slot or notch 38 formed therein and communicating with the engaging hole 37 of the driving member 30 for selectively aligning with or communicating with the opening 14 of the driving head 11 and thus for allowing the tool shanks, tool extensions, tool elements, fasteners, driven members (not shown) or the like to be easily and quickly engaged through the opening 14 of the driving head 11 and the notch 38 and then engaged into the engaging hole 37 of the driving member 30. Alternatively, as shown in FIG. 5, the driving head 110 and the driving member 301 may include no gap or slot or opening and notch formed therein.

One or more (such as two) pawls 50 are movably or loosely disposed or attached or mounted or secured or engaged into the recesses 24 of the driving head 11 respectively, and each include a curved or rounded shaft 51 having a semi-tubular or cylindrical structure pivotally or rotatably received or engaged in the respective rounded or curved compartment 26 of the recess 24 of the driving head 11, and each include an extension or stem or lever arm 52 laterally extended outwardly from the shaft 51 and extended into the relatively smaller space 27 of the recess 24 of the driving head 11, and each include one or more teeth 53 formed or provided on the lever arm 52 for selectively engaging with the gear or gear wheel 36 of the driving member 30 and for determining or controlling the rotating or driving direction of the driving member 30 with or by the driving head 11 and the handle 10.

As best shown in FIG. 1, the shaft 51 of the pawl 50 includes a length or height greater than that of the lever arm 52 and extended upwardly and downwardly beyond the lever arm 52 for forming or defining two end portions or segments, such as an upper or first end segment 54 and a lower or bottom or second end segment 55 that are extended upwardly and downwardly or out beyond the lever arm 52 respectively, and for forming or defining two peripheral shoulders or contacting or pressing or engaging surfaces 56 on the end segments 54, 55 respectively, and for selectively engaging with the outer peripheral portions or surfaces 29 of the retaining rings 21-22 (FIGS. 3, 4), and thus for allowing the retaining rings 21-22 to apply a spring biasing force onto and against the end segments 54, 55 of the shaft 51 of the pawl 50, and for biasing and forcing the teeth 53 of the lever arm 52 to engage with the gear 36 that is formed and provided on the cylindrical body element 31 of the driving member 30.

In operation, as shown in FIG. 3, when the driving head 11 and the handle 10 are rotated or driven by the user in a driving direction, such as the clockwise direction, the teeth 53 of the lever arm 52 may be forced to solidly and stably engage with the gear 36 of the driving member 30 such that the driving member 30 may also be rotated or driven by the driving head 11 and the handle 10 in the driving direction, in order to rotate or drive the various tool shanks, tool extensions, tool elements, fasteners, driven members (not shown) or the like. On the contrary, as shown in FIG. 4, when the driving head 11 and the handle 10 are rotated or driven by the user in the opposite or releasing direction, such as the counterclockwise direction, the teeth 53 of the lever arm 52 may be moved away from the gear 36 of the driving member 30 for allowing the driving head 11 and the handle 10 to be pivoted or rotated freely relative to the driving member 30 in the opposite or releasing direction.

It is to be noted that the space 27 of the recess 24 of the driving head 11 includes a size or dimension or volume or area greater than that of the lever arm 52 of the pawl 50 for allowing the lever arm 52 of the pawl 50 to be moved rearwardly away from the gear 36 of the driving member 30 and to be selectively received or engaged in the compartment 26 and/or the space 27 of the recess 24 of the driving head 11. The retaining rings 21-22 are extended into or through the recesses 24 of the driving head 11 and may be solidly and stably engaged with the engaging surfaces 56 of the end segments 54, 55 of the shaft 51 of the pawl 50 for solidly and stably biasing and forcing the teeth 53 of the lever arm 52 to effectively engage with the gear 36. In addition, only the recesses 24 are required to be formed in the driving head 11 for receiving or engaging with the pawls 50, such that the strength of the driving head 11 and the handle 10 will not be decreased or influenced, furthermore, fewer parts or elements are required to be assembled and engaged into the driving head 11 and/or the handle 10 such that the manufacturing cost for the ratchet wrench may also be reduced or decreased.

Accordingly, the ratchet wrench in accordance with the present invention includes an improved structure having fewer parts or elements to be easily and quickly assembled and manufactured with a decreased manufacturing cost and having an increased driving torque or strength for preventing the ratchet wrench from being easily and quickly worn out or damaged, and the driving head may include an opening and the driving member may include a notch for quickly engaging the tool members into the engaging hole of the driving member.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet wrench comprising:

a handle including a driving head provided thereon, said driving head including a chamber formed therein, and including a recess formed in said driving head and communicating with said chamber of said driving head, and including a first peripheral groove and a second peripheral groove formed in said driving head and communicating with said chamber and said recess of said driving head, and including a projection extended into said recess of said driving head for forming and defining a compartment and a space in said recess of said driving head, a first retaining ring and a second retaining ring engaged into said first and said second peripheral grooves of said driving head respectively and extended through said recess of said driving head, a driving member including a body element rotatably received and engaged in said chamber of said driving head, and including a gear formed and provided on said body element and faced and directed toward said first and said second peripheral grooves and said recess of said driving head and said first and said second retaining rings, and a pawl including a shaft received and engaged in said compartment of said recess of said driving head, and including a lever arm extended from said shaft and extended into said space of said recess of said driving head, and including at least one tooth formed and provided on said lever arm for selectively engaging with said gear of said driving member and for determining a driving direction of said driving member by said driving head and said handle, said shaft including a height greater than that of said lever arm and extended beyond said lever arm for forming and defining a first end segment and a second end segment and for forming and defining two engaging surfaces on said first and said second end segments respectively, and for engaging with said first and said second retaining rings respectively and for allowing said first and said second retaining rings to apply a spring biasing force onto said first and said second end segments of said shaft of said pawl respectively, and for biasing and forcing said at least one tooth of said lever arm to engage with said gear, and said at least one tooth of said lever arm being forced to engage with said gear of said driving member when said driving head and said handle are rotated and driven in a driving direction for allowing said driving member to be rotated and driven by said driving head and said handle in the driving direction, and said at least one tooth of said lever arm being allowed to be moved away from said gear of said driving member and to be selectively received and engaged in said space of said recess of said driving head when said driving head and said handle are rotated and driven in an opposite releasing direction, for allowing said driving head and said handle to be rotated freely relative to said driving member in the opposite releasing direction.

2. The ratchet wrench as claimed in claim 1, wherein said compartment of said recess of said driving head is a relatively greater compartment than said space of said recess of said driving head, and said space of said recess of said driving head is a relatively smaller space than said compartment of said recess of said driving head.

3. The ratchet wrench as claimed in claim 1, wherein said driving member includes a peripheral flap extended laterally and outwardly from said body element for contacting and engaging with said driving head and for limiting said driving member to move relative to said driving head and for preventing said driving member from being disengaged from said driving head.

4. The ratchet wrench as claimed in claim 1, wherein said driving head includes a peripheral flange extended radially and inwardly into said chamber of said driving head for forming and defining an inner peripheral shoulder in said driving head, and said driving member includes an outer peripheral shoulder formed therein for engaging with said peripheral flange and said inner peripheral shoulder of said driving head and for anchoring and positioning said driving member to said driving head.

5. The ratchet wrench as claimed in claim 1, wherein said driving head includes a third peripheral groove formed therein, and said driving member includes an outer peripheral depression formed therein and aligned with said third peripheral groove of said driving head for receiving and engaging with a retaining ring and for securing and retaining said driving member to said driving head.

6. The ratchet wrench as claimed in claim 1, wherein said driving head includes an opening formed therein and communicating with said chamber of said driving head, and said driving member includes a notch formed therein for selectively communicating with said opening of said driving head.

* * * * *